US007477018B2

(12) United States Patent
Lee

(10) Patent No.: US 7,477,018 B2
(45) Date of Patent: Jan. 13, 2009

(54) PLASMA DISPLAY APPARATUS AND DRIVING METHOD THEREOF

(75) Inventor: Boong Joo Lee, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 12 days.

(21) Appl. No.: 11/251,818

(22) Filed: Oct. 18, 2005

(65) Prior Publication Data

US 2006/0082309 A1 Apr. 20, 2006

(30) Foreign Application Priority Data

Oct. 18, 2004 (KR) ..... 10-2004-0083311

(51) Int. Cl.
*H01J 17/49* (2006.01)

(52) U.S. Cl. ..... 313/584; 313/582

(58) Field of Classification Search ..... 313/582–587; 345/60

See application file for complete search history.

(56) References Cited

U.S. PATENT DOCUMENTS 5,587,624 A 12/1996 Komaki ..... 313/584
2001/0050533 A1 * 12/2001 Hirose ..... 313/583
2003/0090212 A1 * 5/2003 Park et al. ..... 315/169.1
2004/0041522 A1 * 3/2004 Takada et al. ..... 313/586
2004/0051456 A1 * 3/2004 Kim ..... 313/582
2004/0130269 A1 * 7/2004 Park ..... 313/586
2005/0041001 A1 * 2/2005 Sumida et al. ..... 345/60
2006/0001354 A1 * 1/2006 Chen et al. ..... 313/491

FOREIGN PATENT DOCUMENTS

EP 1 313 124 A2 5/2003
JP 06251712 A * 9/1994

OTHER PUBLICATIONS

European Search Report dated Feb. 20, 2006.
Chinese Office Action dated Mar. 7, 2008.

* cited by examiner

*Primary Examiner*—Karabi Guharay
(74) *Attorney, Agent, or Firm*—Ked & Associates, LLP

(57) ABSTRACT

A plasma display panel of the present invention preferably reduces the luminance differences over a display area of a panel. The reduction in luminance difference is achieved by at least one of changing distances between corresponding scan electrodes or corresponding sustain electrodes of corresponding scan/sustain electrode pairs in different areas of the panel or varying a gap between the scan and sustain electrodes of the scan/sustain electrode pair.

20 Claims, 9 Drawing Sheets

| | | | | | |
|---|---|---|---|---|---|
| $A_1$ = 169 | $A_2$ = 162 | $A_3$ = 157 | $A_4$ = 155 | $A_5$ = 153 | $A_1$ ~$A_5$ = 159.2 |
| $A_6$ = 166 | $A_7$ = 157 | $A_8$ = 154 | $A_9$ = 153 | $A_{10}$ = 151 | $A_6$ ~$A_{10}$ = 156.2 |
| $A_{11}$ = 162 | $A_{12}$ = 154 | $A_{13}$ = 151 | $A_{14}$ = 150 | $A_{15}$ = 148 | $A_{11}$ ~$A_{15}$ = 153 |
| $A_{16}$ = 165 | $A_{17}$ = 159 | $A_{18}$ = 156 | $A_{19}$ = 154 | $A_{20}$ = 153 | $A_{16}$ ~$A_{20}$ = 157.4 |
| $A_{21}$ = 168 | $A_{22}$ = 162 | $A_{23}$ = 159 | $A_{24}$ = 158 | $A_{25}$ = 157 | $A_{21}$ ~$A_{25}$ = 160.8 |

| | | | | | |
|---|---|---|---|---|---|
| $A_1$ = 165 | $A_2$ = 158 | $A_3$ = 154 | $A_4$ = 152 | $A_5$ = 151 | $A_1$ ~$A_5$ = 156 |
| $A_6$ = 166 | $A_7$ = 158 | $A_8$ = 155 | $A_9$ = 152 | $A_{10}$ = 150 | $A_6$~$A_{10}$ = 156.2 |
| $A_{11}$ = 167 | $A_{12}$ = 157 | $A_{13}$ = 156 | $A_{14}$ = 154 | $A_{15}$ = 151 | $A_{11}$~$A_{15}$ = 157 |
| $A_{16}$ = 164 | $A_{17}$ = 157 | $A_{18}$ = 156 | $A_{19}$ = 155 | $A_{20}$ = 151 | $A_{16}$~$A_{20}$ = 156.6 |
| $A_{21}$ = 163 | $A_{22}$ = 158 | $A_{23}$ = 156 | $A_{24}$ = 154 | $A_{25}$ = 152 | $A_{21}$~$A_{25}$ = 156.6 |

| | | | | | |
|---|---|---|---|---|---|
| $A_1$ = 166 | $A_2$ = 159 | $A_3$ = 156 | $A_4$ = 153 | $A_5$ = 150 | $A_1$ ~$A_5$ = 156.8 |
| $A_6$ = 167 | $A_7$ = 160 | $A_8$ = 157 | $A_9$ = 152 | $A_{10}$ = 151 | $A_6$ ~$A_{10}$ = 157.4 |
| $A_{11}$ = 169 | $A_{12}$ = 159 | $A_{13}$ = 156 | $A_{14}$ = 153 | $A_{15}$ = 151 | $A_{11}$ ~$A_{15}$ = 157.6 |
| $A_{16}$ = 166 | $A_{17}$ = 156 | $A_{18}$ = 155 | $A_{19}$ = 154 | $A_{20}$ = 152 | $A_{16}$ ~$A_{20}$ = 156.6 |
| $A_{21}$ = 164 | $A_{22}$ = 159 | $A_{23}$ = 156 | $A_{24}$ = 153 | $A_{25}$ = 152 | $A_{21}$ ~$A_{25}$ = 156.8 |

PLASMA DISPLAY APPARATUS AND DRIVING METHOD THEREOF

This Nonprovisional application claims priority under 35 U.S.C. § 119(a) on Patent Application No. 10-2004-0083311 filed in Korea on Oct. 18, 2004, the entire contents of which are hereby incorporated by reference.

BACKGROUND OF THE INVENTION

1. Field of the Invention

The present invention generally relates to a display device, and more particularly, to a plasma display panel.

2. Description of the Background Art

Generally, the plasma display panel is a display device which includes an upper substrate, a lower substrate, and a barrier rib that is produced between the upper substrate and the lower substrate. Each cell is mainly filled with discharge gas such as Ne, He, or Ne+He and also contains inert gas, such as small amount of xenon. Upon being discharged by applying high frequency voltage, the inert gas generates ultraviolet rays (preferably vacuum ultraviolet rays), thereby to emit light by fluorescent substance on the lower substrate and/or the barrier ribs to realize an image. Such plasma display panels are relatively thin and lightweight and are preferable as next generation display device compared to CRT or LCD.

FIG. 1 is a structural diagram that shows the electrode arrangement of a plasma display panel. As shown, the electrode arrangement of plasma display panel includes a plurality of scan electrodes Y1 to Yn and a plurality of sustain electrodes Z1 to Zn, which are respectively paired. The scan electrodes and the sustain electrodes are originated from the scan electrode pad 21 and sustain electrode pad 22 and on the upper substrate 20. The distance between the plurality of scan electrodes is uniformly maintained within error range through the upper substrate 20, and the distance between the plurality of sustain electrodes is uniformly maintained within the error range through the upper substrate 20. Further, the distance between the scan electrodes and the sustain electrodes maintain uniformly.

In a plasma display panel with such electrode structure, the electrode structure within discharge cell is shown in FIG. 2. The electrode structure within discharge cell of the plasma display panel include a bus electrode b of the scan electrode 101 and the sustain electrode 102 formed on both side of the discharge cell, respectively on an upper substrate, and a transparent electrode a of the scan electrode 101 and the sustain electrode 102 formed respectively on both side which each bus electrode b are formed so that they are opposite each other while leaving center of a discharge cell between them.

Corresponding address electrode on a lower substrate crosses with the bus electrode b and the transparent electrode a within each discharge cell. Although not shown, the cell has fluorescent materials within the discharge cell for emitting R, G, and B rays upon cell discharge.

In the plasma display panel with such electrode structure within discharge cell, if corresponding voltages are provided to corresponding transparent electrode a of the scan electrode 101 and the sustain electrode 102 and the corresponding address electrode within a cell, a discharge occurs in the cell and the fluorescent materials emit light, thereby to display image.

The luminance property in each section of the plasma display panel is shown in FIG. 3. If the corresponding signals, i.e. signals of 180V, 1.14 A, are applied to each of the scan electrodes and the sustain electrodes, sections A1 to A5 exhibits an average luminance of 159.2, sections A6 to A10 exhibits an average luminance of 156.2, sections A11 to A15 exhibits an average luminance of 153, sections A16 to A20 exhibits an average luminance of 157.4, and sections A21 to A25 exhibits an average luminance of 160.8. In other words, if the same signals are applied to the scan electrodes and the sustain electrodes formed in the plasma display panel, each section in the upper substrate 100 of the plasma display panel exhibits different luminance.

Such luminance irregularity to be exhibited in all sections of the upper substrate corresponding to a display plane of the plasma display panel causes deterioration of image quality, and decreased reliance of the plasma display panel.

SUMMARY OF THE INVENTION

Accordingly, an object of the present invention is to solve at least the problems and disadvantages of the background art.

This present invention is to provide a plasma display panel that preferably reduces luminance difference of plasma display panel.

According to one embodiment of this invention, the plasma display panel comprises an upper substrate, and a plurality of scan electrodes and sustain electrodes that are formed on the upper substrate, and is characterized that the upper substrate is divided vertically into an upper section, a center section and a lower section such that a distance between adjacent scan electrodes and between adjacent sustain electrodes located in the center section of the upper substrate is different from a distance between the scan electrodes and between the sustain electrodes located in the upper section or the lower section of the upper substrate.

According to an embodiment of this invention, a plasma display panel comprises an upper substrate, and a plurality of scan electrodes and sustain electrodes that is formed on the upper substrate, and is characterized that the upper substrate is divided vertically into an upper section, a center section and a lower section such that a distance between the scan electrodes and the sustain electrodes that are located in the center section of the upper substrate is different from a distance between the scan electrodes and the sustain electrodes that are located in the upper section or the lower section of the upper substrate.

According to an embodiment of this invention, a plasma display panel comprises an upper substrate, and a plurality of scan electrodes and sustain electrodes that are consisted of transparent electrodes and bus electrodes respectively on the upper substrate, and is characterized that the upper substrate is divided vertically into an upper section, a center section and a lower section such that a distance between the transparent electrodes of the scan electrodes and the transparent electrodes of the sustain electrodes located in the center section of the upper substrate is different from a distance between the transparent electrodes of the scan electrodes and the transparent electrodes of the sustain electrodes located in the upper section or the lower section of the upper substrate.

According to first embodiment of this invention, the plasma display panel comprises an upper substrate, and a plurality of scan electrodes and sustain electrodes that is formed on the upper substrate, and is characterized that the upper substrate is divided vertically into an upper section, a center section and a lower section such that a distance between adjacent scan electrodes and between adjacent sustain electrodes located in the center section of the upper substrate is different from a distance between the scan electrodes and between the sustain electrodes located in the upper section or the lower section of the upper substrate.

The invention is characterized in that the center section of the upper substrate is set to be 10% of entire vertical plane of the upper substrate in vertical direction from center line of the scan electrodes and the sustain electrodes of the upper substrate.

The invention is characterized in that a distance between the adjacent scan electrode and between the adjacent sustain electrode located in the center section of the upper substrate is defined smaller than a distance between the scan electrode and between the sustain electrode located in the upper section or the lower section of the upper substrate.

The invention is characterized in that the upper substrate is divided vertically into the upper section, the center section, and the lower section that have the same length respectively, each distance between the scan electrodes and between the sustain electrodes included in each section is the same respectively.

The invention is characterized in that the upper substrate is divided vertically into the upper section, the center section, and the lower section that have the same length respectively, and each distance between the scan electrodes and between the sustain electrodes included in each section of the upper substrate increases by constant amount respectively as it advances gradually from the center section of the upper substrate into the upper section or the lower section.

The invention is characterized in that the scan electrodes and the sustain electrodes is consisted of only bus electrodes respectively.

According to second embodiment of this invention, a plasma display panel comprises an upper substrate, and a plurality of scan electrodes and sustain electrodes that is formed on the upper substrate, and is characterized that the upper substrate is divided vertically into an upper section, a center section and a lower section such that a distance between the scan electrodes and the sustain electrodes that are located in the center section of the upper substrate is different from a distance between the scan electrodes and the sustain electrodes that are located in the upper section or the lower section of the upper substrate.

The invention is characterized in that the center section of the upper substrate is set to be 10% of entire vertical plane of the upper substrate in vertical direction from center line of the scan electrodes and the sustain electrodes of the upper substrate.

The invention is characterized in that the distance between the adjacent scan electrode and between the adjacent sustain electrode located in the center section of the upper substrate is defined smaller than the distance between the scan electrode and between the sustain electrode located in the upper section or the lower section of the upper substrate.

The invention is characterized in that the upper substrate is divided vertically into the upper section, the center section, and the lower section that have the same length respectively, each distance between the scan electrodes and between the sustain electrodes included in each section is the same respectively.

The invention is characterized in that the upper substrate is divided vertically into the upper section, the center section, and the lower section that have the same length respectively, and each distance between the scan electrodes and between the sustain electrodes included in each section of the upper substrate increases by constant amount respectively as it advances gradually from the center section of the upper substrate into the upper section or the lower section.

The invention is characterized in that the scan electrodes and the sustain electrodes is consisted of only bus electrodes respectively.

According to third embodiment of this invention, a plasma display panel comprises an upper substrate, and a plurality of scan electrodes and sustain electrodes that are consisted of transparent electrodes and bus electrodes respectively on the upper substrate, and is characterized that the upper substrate is divided vertically into an upper section, a center section and a lower section such that a distance between the transparent electrodes of the scan electrodes and the transparent electrodes of the sustain electrodes located in the center section of the upper substrate is different from a distance between the transparent electrodes of the scan electrodes and the transparent electrodes of the sustain electrodes located in the upper section or the lower section of the upper substrate.

The invention is characterized in that the center section of the upper substrate is set to be 10% of entire vertical plane of the upper substrate in vertical direction from center line of the scan electrodes and the sustain electrodes of the upper substrate.

The invention is characterized in that the distance between the adjacent scan electrode and between the adjacent sustain electrode located in the center section of the upper substrate is defined smaller than the distance between the scan electrode and between the sustain electrode located in the upper section or the lower section of the upper substrate.

The invention is characterized in that the upper substrate is divided vertically into the upper section, the center section, and the lower section that have the same length respectively, each distance between the scan electrodes and between the sustain electrodes included in each section is the same respectively.

The invention is characterized in that the upper substrate is divided vertically into the upper section, the center section, and the lower section that have the same length respectively, and each distance between the scan electrodes and between the sustain electrodes included in each section of the upper substrate increases by constant amount respectively as it advances gradually from the center section of the upper substrate into the upper section or the lower section.

The invention is characterized in that the scan electrodes and the sustain electrodes is consisted of only bus electrodes respectively.

The object can be achieved in parts or in a whole by a plasma display panel, comprising a plurality of paired electrodes, each paired electrode including a scan electrode and sustain electrode in a first direction; a plurality of address electrodes in a second direction, which is substantially perpendicular to the first direction; and a plurality of cells, each cell being formed near or at an intersection of corresponding paired electrode and address electrode, wherein the plurality of cells are divided into a plurality of areas, each area including at least two paired electrodes such that the at least two paired electrodes include first and second pairs, and a prescribed distance being formed between a scan electrode of the first pair and a scan electrode of a second pair or between a sustain electrode of the first pair and a sustain electrode of the second pair or between cells in the second direction, wherein the prescribed distance of at least one area is different from the prescribed distance of at least one other area.

The object can be achieved in parts or in a whole by a plasma display panel comprising a plurality of scan electrodes arranged in a first direction; and a plurality of sustain electrodes arranged in the first direction, the first scan electrodes and the second sustain electrodes forming a plurality of electrode pairs and a scan electrode of a pair being spaced apart from a sustain electrode of the pair by a gap of a prescribed distance, wherein the plurality of electrode pairs being distributed between a plurality of regions, each region having at least one electrode pair, and the prescribed distance of at least one region is different from the prescribed distance of at least one other region.

The objects can be achieved in parts or in a whole by a method of making a plasma display panel comprising providing an upper substrate having a plurality of paired electrodes, each paired electrode including a scan electrode and sustain electrode; providing a lower substrate having a plurality of address electrodes, and a plurality of barrier ribs, each discharge cell being formed near or at an intersection of corresponding paired electrode and address electrode, wherein at least one of: (a) the plurality of cells are divided into a plurality of areas, each area including at least two paired electrodes such that the at least two paired electrodes include first and second pairs, and a prescribed distance being formed between a scan electrode of the first pair and a scan electrode of a second pair or between a sustain electrode of the first pair and a sustain electrode of the second pair or between cells in the second direction, and the prescribed distance of at least one area is different from the prescribed distance of at least one other area, or (b) a scan electrode of a paired electrode being spaced apart from a sustain electrode of the paired electrode by a gap of a prescribed distance, the plurality of paired electrodes being distributed between a plurality of regions, each region having at least one paired electrode, and the prescribed distance of at least one region is different from the prescribed distance of at least one other region.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

BEST MODE OR DESCRIPTION OF EMBODIMENTS

Figure 1:
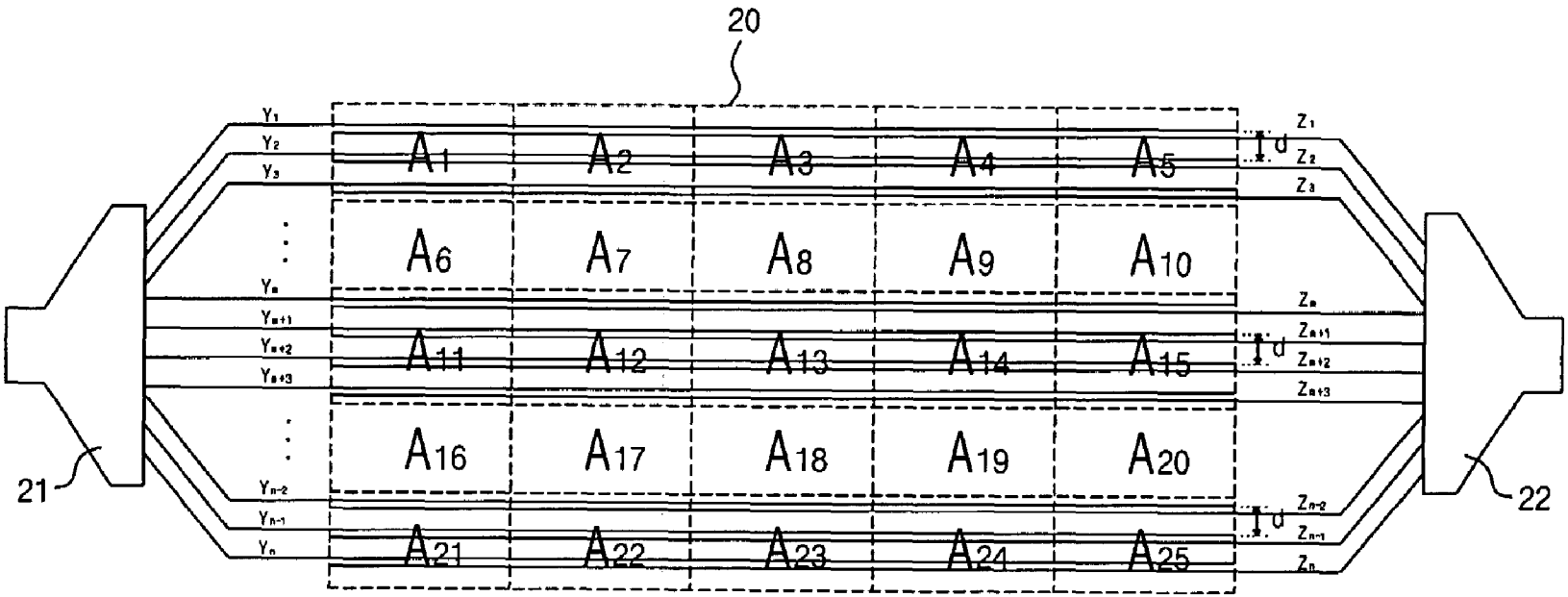
FIG. 1 is a structural diagram showing the electrode arrangement of the plasma display panel.
Figures 2, 3:
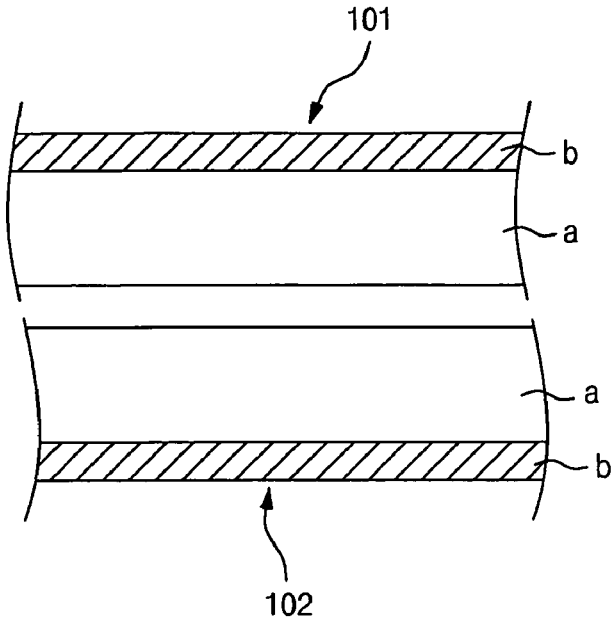
FIG. 2 is a diagram showing the electrodes structure within discharge cell of a plasma display panel.
FIG. 3 is a diagram that illustrates the luminance property exhibited in the upper substrate that is the display plane of the plasma display panel.
Figure 4:
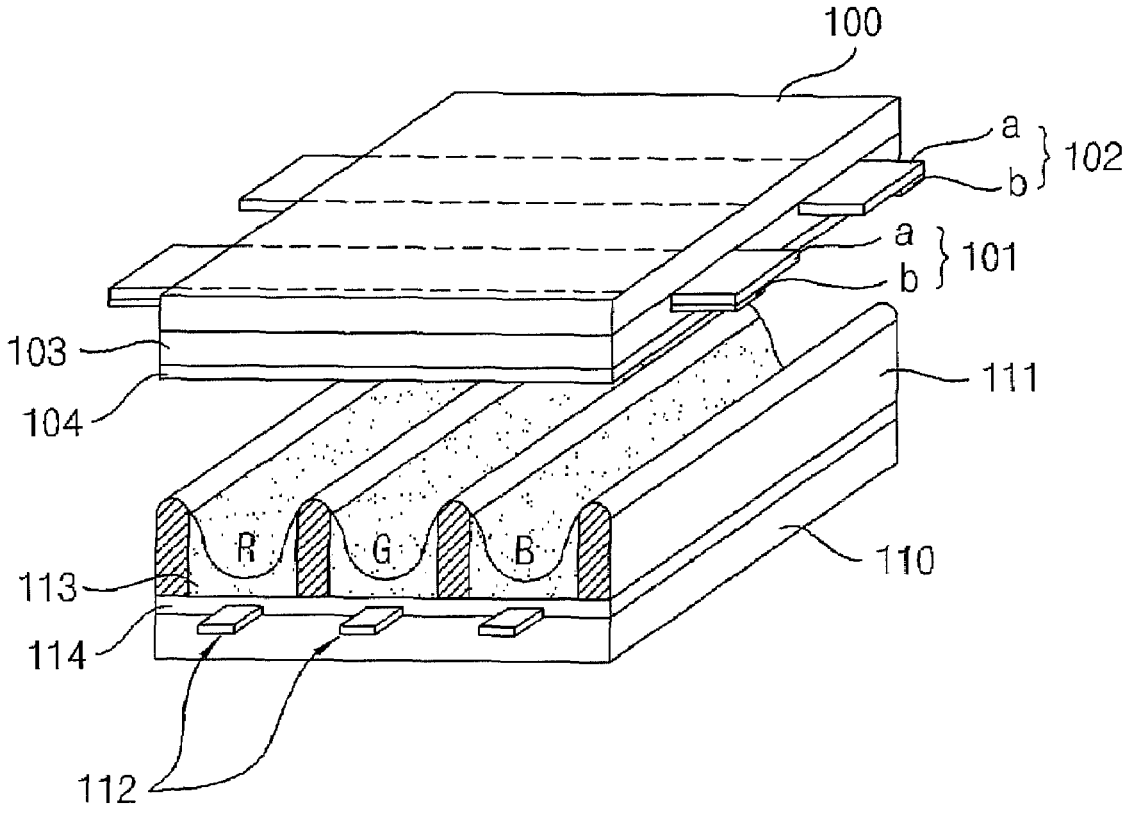
FIG. 4 is a diagram showing a structure of a plasma display panel.

FIG. 4 is a structural diagram showing a plasma display panel in accordance with an embodiment of the present invention. An upper substrate 100 serves as a display plane on which image is to be displayed and a lower substrate 110 serves as a back plane. The upper substrate 100 and the lower substrate are combined in parallel at a predetermined distance.

The upper substrate 100 includes paired scan electrodes 101 and sustain electrodes 102, i.e., paired scan electrodes 101 and sustain electrodes 102, having transparent electrodes 101*a* and 102*a* made of transparent (indium tin oxide) ITO material and bus electrodes 101*b* and 102*b* made of a metal material, for causing a discharge in a cell and maintaining the discharge in the cell. The scan electrodes 101 and the sustain electrodes 102 are covered with a dielectric layer 103 for limiting discharge currents and for insulating the electrode pairs, and a protection layer 104 of Magnesium Oxide (MgO) for facilitating discharge conditions on the dielectric layer 103. As can be appreciated, one insulating material may be used instead of the dielectric layer and a protection layer.

The lower substrate 110 includes barrier ribs 111 of stripe type (or well type) arranged in parallel for generating a plurality of discharge spaces, i.e. discharge cells. Further, a plurality of address electrodes 112 are arranged in parallel with the barrier ribs 111. The lower substrate 110 is spread with R, G, B fluorescent substance that emits visible rays for displaying image upon a discharge in the cell. A dielectric 114 is provided between the address electrodes 112 and the fluorescent substance 113 for protecting the address electrodes 112 and reflecting visible rays emitted from the fluorescent substance to the upper substrate 100. In alternative embodiments, the barrier ribs can be also formed in the direction of the scan/sustain electrodes in addition to the barrier ribs in the direction of the address electrodes. The plasma display panel may have R, G, B cells formed in a delta configuration rather than in a row of R, G, B cells.

Embodiment(s) of the Invention

Figure 5A:
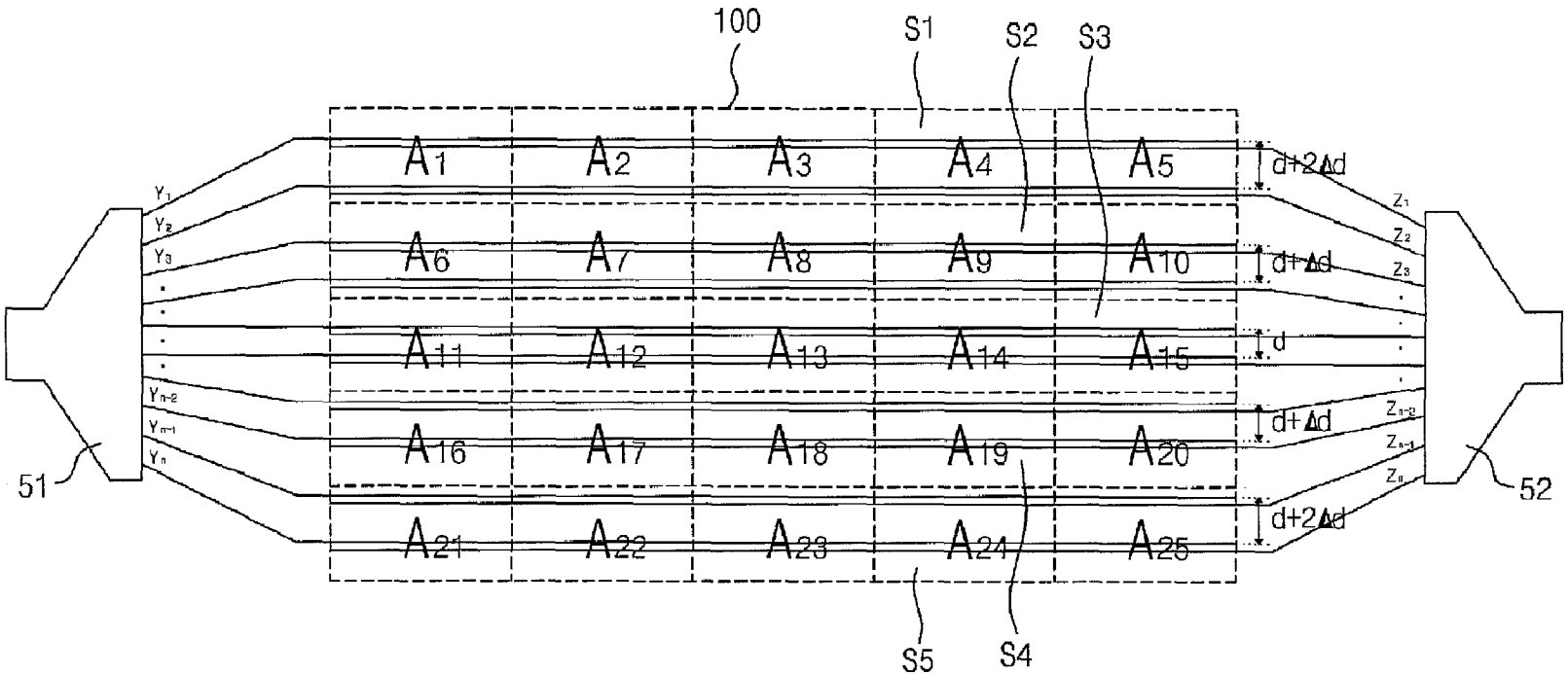
FIG. 5A is a structural diagram that illustrates the electrode arrangement of the plasma display panel according to an embodiment of the invention.

FIG. 5A is a structural diagram that illustrates the electrode arrangement of a plasma display panel according to one embodiment of this invention. As shown therein, a plurality of scan electrodes Y1 to Yn and sustain electrodes Z1 to Zn are paired respectively and arranged within discharge cell on a upper substrate 100. The scan electrodes originate from an electrode pad 51 or are provided from scan driver (not shown). The sustain electrodes originate from an electrode pad 52 or are provided form a sustain driver (not shown). Since details of the electrode pads and/or drivers are appreciated by one of ordinary skill, such description is omitted.

The upper substrate 100 is preferably divided or classified into an upper area including areas S1 and S2, e.g., sections A1-A10, a center area including area S3, e.g., sections A11-A15, and a lower area including areas S4 and S5, e.g., sections A16-A25. As shown, a distance d between the scan electrodes of the electrode pairs or a distance d between the sustain electrodes of the electrode pairs located on the center section are different or varies from a distance (d+Δd or d+2Δd) between the scan electrodes of the electrode pairs or the distance (d+Δd or d+2Δd) between the sustain electrodes of the electrode pairs located on the lower area or upper area. Preferably, the distance between the scan electrodes or between the sustain electrodes located on the center section is smaller than the distance between the scan electrodes or between the sustain electrodes located on the lower area and/or the upper area.

Figure 5B:
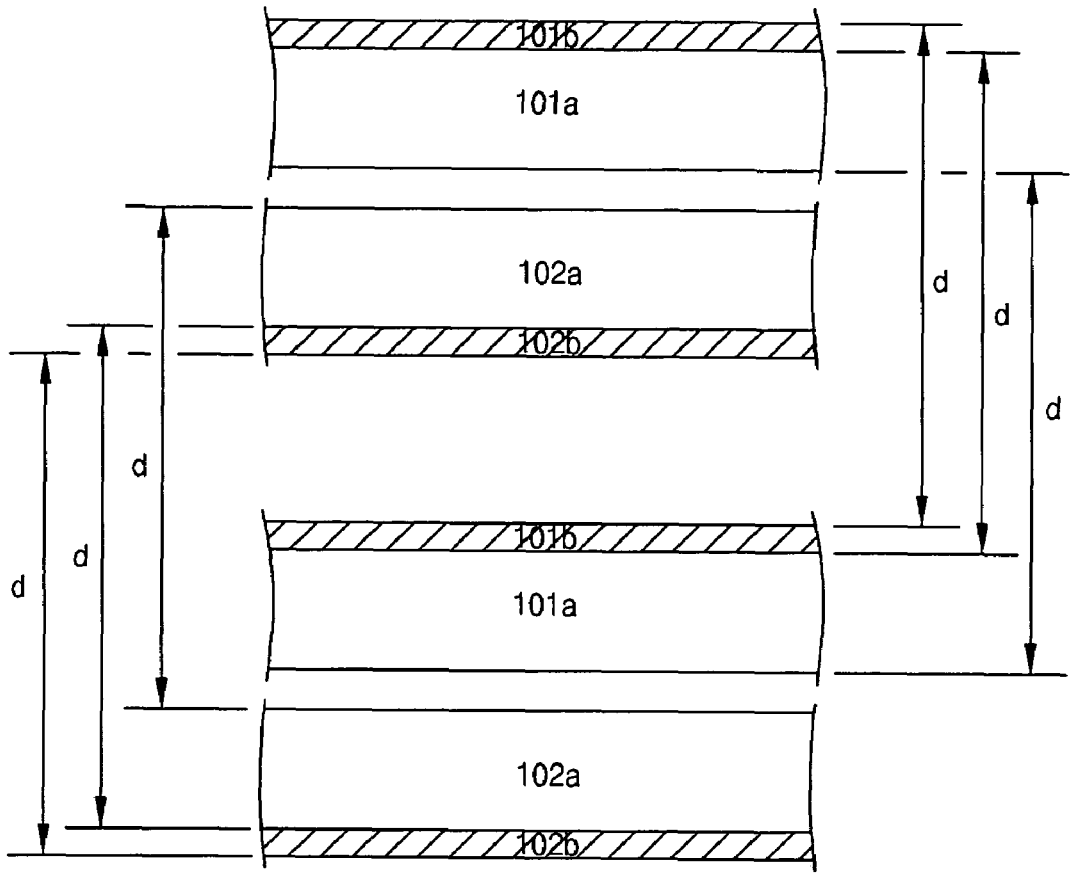
FIG. 5B-5D illustrate details of FIG. 5A.
Figure 5C:
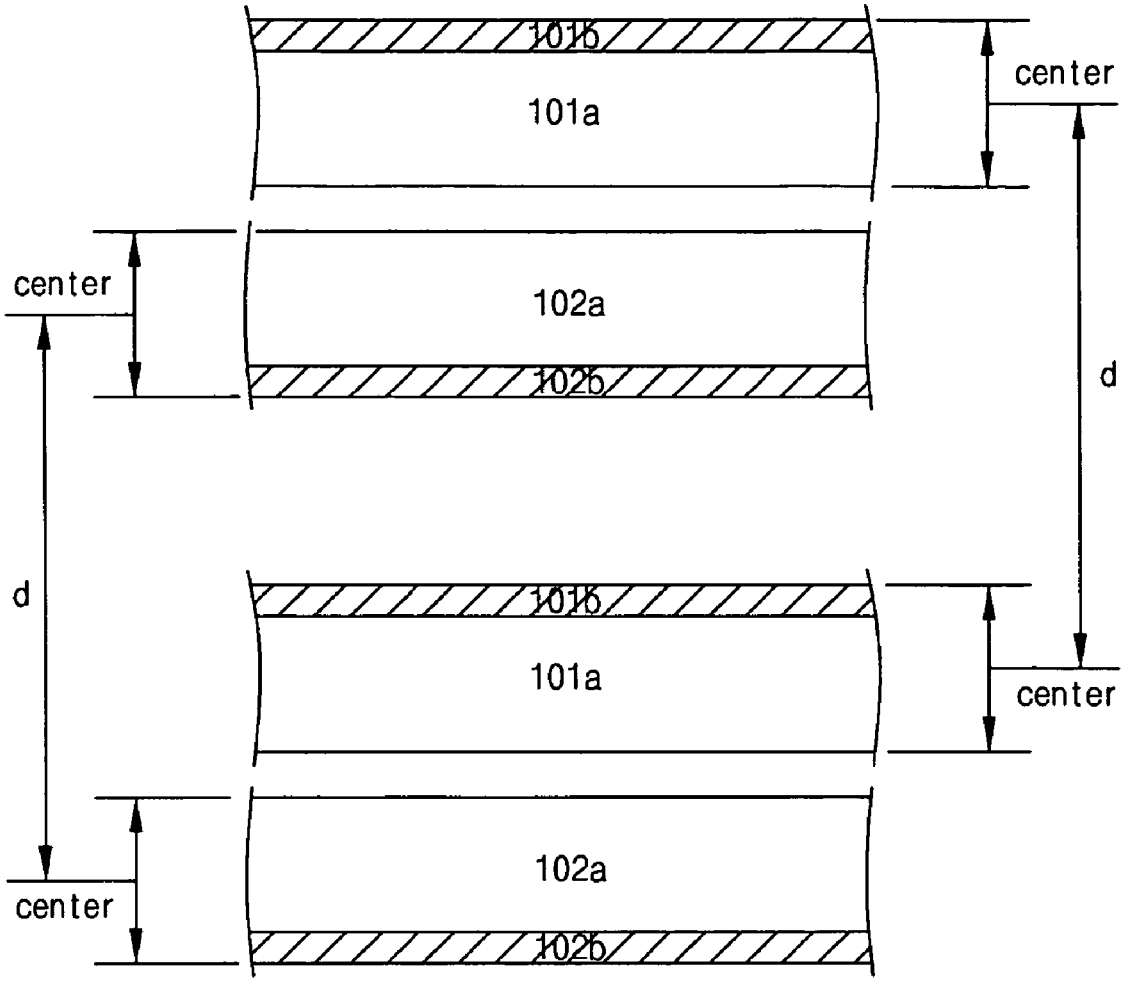
Figure 5D:
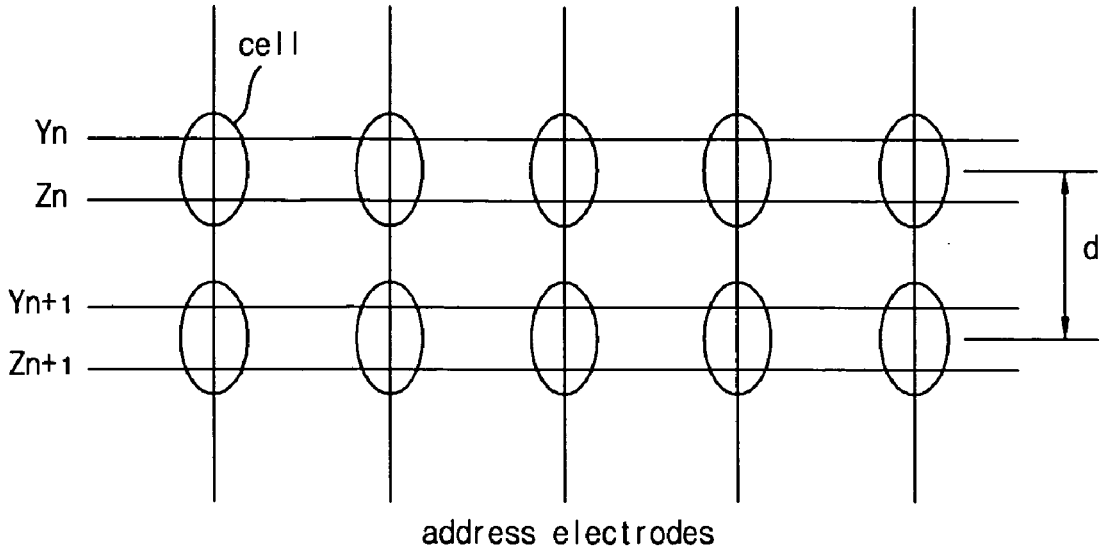

It should be noted that the distance between the scan electrodes and between the sustain electrodes refers to the distance between scan electrodes of adjacent electrode pairs or between sustain electrodes of adjacent electrode pair, as shown in FIGS. 5B-5C. Alternatively, the distance may be defined as a distance between adjacent column cells, as shown in FIG. 5D. While the scan electrodes and the sustain electrodes are preferably of transparent electrodes and bus electrodes, the scan electrode or sustain electrode may be a single transparent electrode or a single bus electrode to reduce material cost and/or cell size.

Because the distance between the scan electrodes or between the sustain electrodes located on the center area is smaller than the distance between the scan electrodes or between the sustain electrodes located on the lower area or the upper area, a larger discharge or brighter light emission is provided in the center section of the panel than those on the upper section and lower section.

FIG. 5A has been drawn generally to illustrate the novel and non-obvious aspect of the invention. Although two electrode pairs are shown for upper, center and lower sections, one of ordinary skill will appreciate that the number of electrode pairs within each section classification and/or division is based on a resolution. For example, if the horizontal resolution of the plasma display panel is 480, where there are preferably 480 electrode pairs, i.e., $Y_1$ $Z_1$ to $Y_{480}$ $Z_{480}$, a prescribed number of electrode pairs would classified into the upper, center and lower area. Where there are multiple electrode pairs in each area, the distance (d, d+Δd, d+2Δd, etc.) between scan electrodes or sustain electrodes is measured between the following electrodes of the electrode pairs or between cells in a column direction:

(1) distance between scan electrode $Y_n$ and scan electrode $Y_{(n+1)}$, where n=1, 3, 5, 7, 9, etc. (odd numbers); or (b) distance between sustain electrode $Z_n$ and sustain electrode $Z_{(n+1)}$, where n=1, 3, 5, 7, 9, etc; or (c) distance between row cells $C_n$ and $C_{(n+1)}$ in a column direction, where n=1, 3, 5, 7, 9, etc.

As can be appreciated by one of ordinary skill in the art, the labeling of the electrode pairs or cells is arbitrary. If the first electrode pair $Y_1Z_1$ is labeled as $Y_0Z_0$, one of ordinary skill in the art can readily appreciate that n=0, 2, 4, 6, 7, etc (even numbers).

Figure 5E:
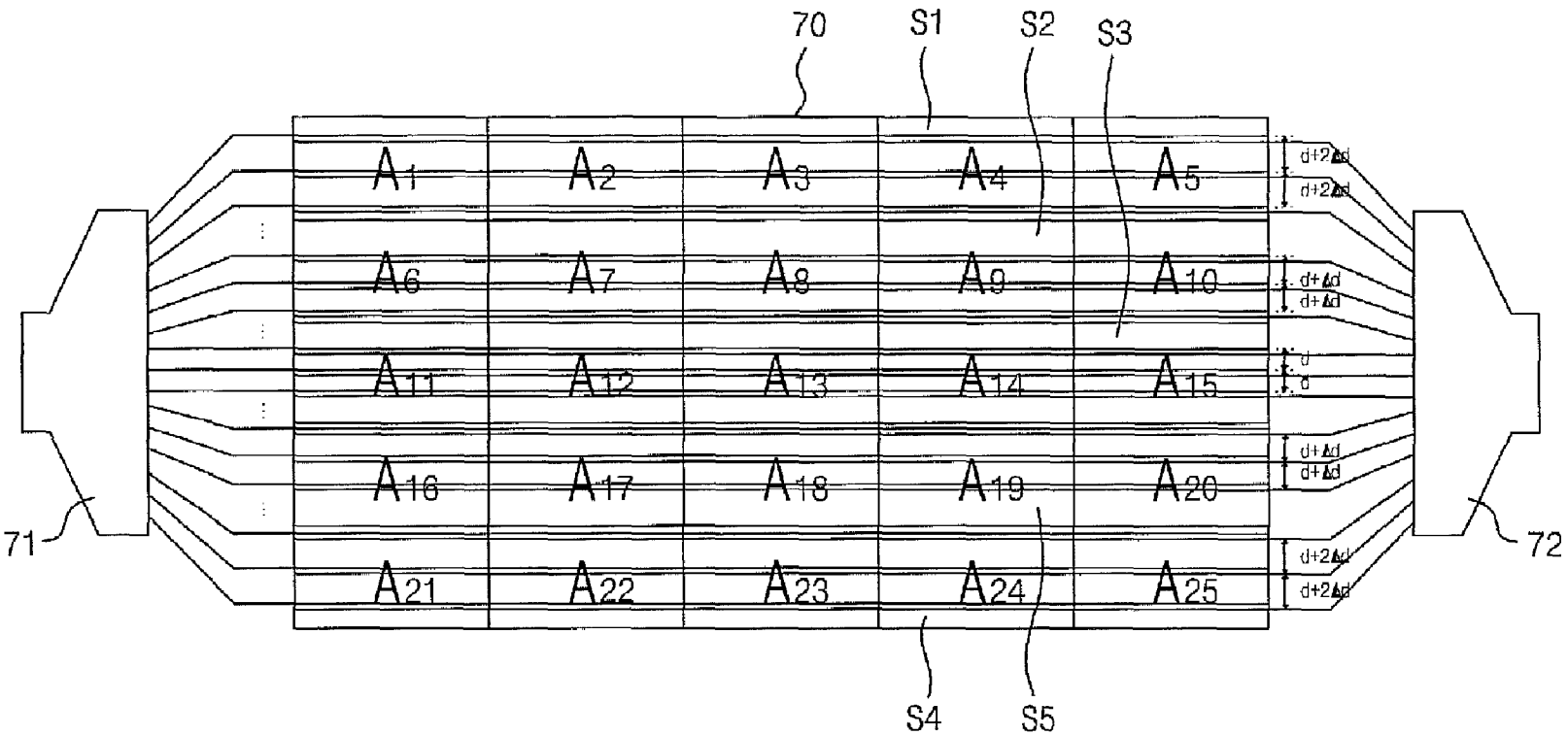
FIG. 5E is a structural diagram that illustrates another electrode arrangement of a plasma display panel according to the invention.

FIG. 5E illustrates a variation of the embodiment of FIG. 5A. In this variation embodiment, where there are multiple electrode pairs in each area, the distance (d, d+Δd, d+2Δd, etc) between scan electrodes or sustain electrodes is measured between the following electrodes of the electrode pairs or between cells in a column direction:

(1) distance between scan electrode $Y_n$ and $Y_{(n+1)}$, where n=1, 2, 3, 4, 5, 6, 7, etc; or (2) distance between sustain electrode $Z_n$ and $Z_{(n+1)}$, where n=1, 2, 3, 4, 5, 6, 7, etc; or (3) distance between center of cells $C_n$ and $C_{(n+1)}$ in a column direction, where n=1, 2, 3, 4, 5, 6, 7, etc.

As can be appreciated by one of ordinary skill, the labeling of the electrode pairs or row cells is arbitrary. If the first electrode pair $Y_1Z_1$ is labeled as $Y_0Z_0$, one of ordinary skill can readily appreciate that n=0, 1, 2, 3, 4, 5, 6, 7, etc. Further, the details of FIGS. 5B-5D is applicable to this embodiment.

Although it is preferable that size or area of the center section of the upper substrate is set equally to that of the upper section and the lower section of the upper substrate for facilitating the process of producing electrodes on the upper substrate, the center area of the upper substrate is set to be at least 10% of the vertical entire plane of the upper substrate in up and down direction from center line of the scan electrode and the sustain electrode so that each distance between the scan electrodes and between the sustain electrodes can be adjusted as described above. For example, if there are 480 electrode pairs, at least 48 electrode pairs are provided in the center area of sections A11-A15. This is readily adjustable based a resolution of a plasma panel device.

This is to reduce the luminance difference to be exhibited in the upper substrate. That is, if the center section of the upper substrate is set to be more than 10% of the vertical entire plane of the upper substrate in up and down direction from center line of the scan electrodes and the sustain electrodes so that each distance between the scan electrodes and between the sustain electrodes may be adjusted as described above, the upper section and the lower area may exhibit better luminance property than the center area, which results in consistent luminance as a whole.

In both embodiments, the distance between the scan electrodes and between the sustain electrodes located in each of the upper section, the center section and the lower section of the upper substrate is preferably different. FIGS. 5A and 5E, the distance between the scan electrodes and between the sustain electrodes in upper area of sections A1-A5 and sections A6-A10 and lower area of sections A16-A20 and sections A21-A25 increases by Δd (a fraction of distance d) from center line of the scan electrodes and the sustain electrodes line located on the center area of sections A1-A15.

For example, each distance between two scan electrodes or between two sustain electrodes located on center area S3 including sections A11-A15 of the upper substrate 100 is d. Each distance between the scan electrodes or between the sustain electrodes located under and/or above, i.e., area S4 including sections A16-A20 and/or area S2 including sections A6-A10, the center area S3 is d+Δd Further, each distance between scan electrodes or between sustain electrodes in area S1 including sections A1-A5 and/or area S5 including sections A21-A25 is d+2Δd that is Δd larger than the distance between the previous upper area and/or lower area.

Although not shown, if additional upper areas and/or lower areas are provided above sections A1-A5 and/or below sections A21-A25, the additional areas preferably include distances of d+3Δd, and thereafter a distance of d+4Δd. The number of sections above and/or below the center section depends upon the size and/or luminance property of the plasma display panel. Depending upon the number of sections, the distance can increase by mΔd, where m=1 to 8, but preferably m is no grater than 4.

In the illustrated embodiments, there are preferably equal number of areas above and below the center area, but such uniform number of areas is not absolutely required. For example, there may be more areas above the center area than the number of areas below the center area, e.g., although the size and/or area of the upper section may be the same as the lower area, there may be greater or less number of divisions in the upper area than the lower area.

Further, FIGS. 5A and 5E illustrate areas which are uniform in size and/or area. However, such illustrations are exemplary since each area need not be uniform in size and/or area. For example, the center area (A11-A15) size/area may be smaller or larger than the upper area (A6-A10 or A1-A5) size/area and/or the lower area (A16-A20 or A21-A25) size/area. Alternatively or in addition, the upper area (A6-A10) size/area may be smaller or larger than the lower area (A16-A20) size/area, in which case, the upper area (A1-A5) size/area would be respectively larger or smaller than the lower area (A21-A25) size/area. Other variations are readily appreciated by one of ordinary skill based on the present disclosure.

FIGS. 5A and 5E also illustrate Δd increasing uniformly, but the present invention is not limited to uniform increments in the upper and lower areas. For example, the upper area may increase by increments of 2Δd whereas the lower area increases by increments of Δd, or vice versa. Alternatively, and/or in addition, the distance in area S4 (A16-A20) may be d+Δd and the distance in area S5 (A21-A25) may be d+3Δd, whereas the distance in the upper areas S1 and S2 increase uniformly. Other variations are readily appreciated by one of ordinary skill based on the present disclosure.

Figures 6, 7, 8:
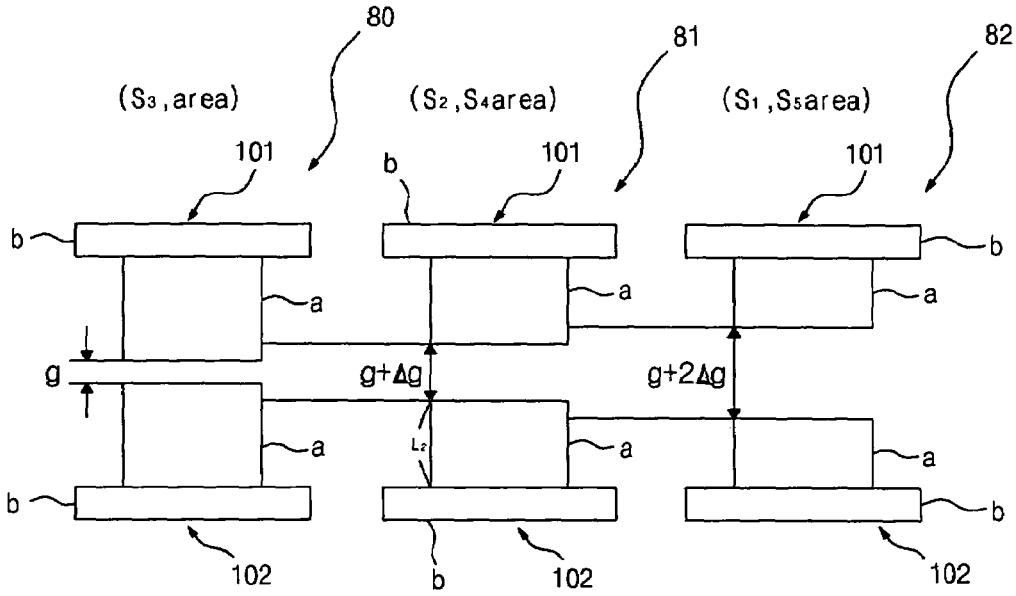
FIG. 6 is a diagram that illustrates the luminance property of each area in the plasma display panel with the electrode structure of FIG. 5A or FIG. 5E.
FIG. 7 is a diagram showing the electrode structure within discharge cell of the plasma display panel according to another embodiment of the invention.
FIG. 8 is a diagram that illustrates the luminance property of each area in the plasma display panel with the electrode structure of FIG. 7.

FIG. 6 illustrates the luminance property that is exhibited in each section of the plasma display panel with such electrode structure as shown in FIG. 5A or 5E if signals of 180V, 1.14 A are applied to each of the scan electrodes and the sustain electrodes. Area S1 including A1 to A5 of the upper substrate exhibits an average luminance of 156, area S2 including A6 to A10 exhibits an average luminance of 156.2, area S3 including A11 to A15 exhibits an average luminance of 157, area S4 including A16 to A20 exhibits an average luminance of 156.6, and area S5 including A21 to A25 exhibits an average luminance of 156.6.

The plasma display panel according to this invention exhibit substantially consistent luminance within relatively smaller error range in vertical direction of the upper substrate. Hence, it is possible to reduce the vertical luminance difference in the plasma display panel.

Another Embodiment of the Invention

FIG. 7 is a diagram showing the electrode structure within discharge cell of the plasma display panel according to another embodiment of the present invention. The electrode structure within the discharge cell of the plasma display panel are divided into areas $S_1$-$S_5$ similar to FIGS. 5A and 5E. However, this embodiment may be used together with changes in distance d of the previous embodiment(s) or separately, where the distance remains constant throughout areas $S_1$-$S_5$.

The scan electrodes 101 and the sustain electrodes 102 of an electrode pair includes transparent electrodes a and bus electrodes b. The span of distance or gap g between the transparent electrodes of the scan electrode 101 and the sustain electrode 102 within the discharge cell 80 located in the center area S3 is different, e.g., smaller, from the span of distance or gap, e.g., g+xΔg, where Δg is a fraction of gap g, and x is between 1 to 8, but preferably no greater than 4, between the transparent electrodes of the scan electrode 101 and the sustain electrode 102 within the discharge cell 81 or 82 located on the lower areas S1, S2 or the upper areas S4, S5.

Although it is preferable that size or area of the center section of the upper substrate is set equally to that of the upper section and the lower section of the upper substrate for facilitating the process of producing electrodes on the upper substrate, the center area of the upper substrate is set to be at least 10% of the vertical entire plane of the upper substrate in up and down direction from center line of the scan electrode and the sustain electrode so that each distance between the scan electrodes and between the sustain electrodes can be adjusted as described above. For example, if there are 480 electrode pairs, at least 48 electrode pairs are provided in the center area of sections A11-A15. This is readily adjustable based a resolution of a plasma panel device. In this embodiment, g is preferably 60 micrometers (μm) and Δg is preferably 10-20 micrometers (μm) for a plasma panel device having a resolution of 480.

Although not shown, if additional upper areas and/or lower areas are provided above sections A1-A5 and/or below sections A21-A25, the additional areas preferably include distances of g+3Δg, and thereafter a distance of g+4Δg. The number of sections above and/or below the center section depends upon the size and/or luminance property of the plasma display panel.

In the illustrated embodiments, there is preferably equal number of areas above and below the center area, but such uniform number of areas is not absolutely required. For example, there may be more areas above the center area than the number of areas below the center area, e.g., although the size and/or area of the upper section may be the same as the lower area, there may be greater or less number of divisions in the upper area than the lower area.

Similar to the description for FIGS. 5A and 5E, each area need not be uniform in size and/or area. For example, the center area (A11-A15) size/area may be smaller or larger than the upper area (A6-A10 or A1-A5) size/area and/or the lower area (A16-A20 or A21-A25) size/area. Alternatively or in addition, the upper area (A6-A10) size/area may be smaller or larger than the lower area (A16-A20) size/area, in which case, the upper area (A1-A5) size/area would be respectively larger or smaller than the lower area (A21-A25) size/area. Other variations are readily appreciated by one of ordinary skill based on the present disclosure.

Further, the present invention is not limited to uniform increments in the upper and lower areas. For example, the gap of the upper area may increase by increments of 2Δg whereas the gap of the lower area increases by increments of Δg, or vice versa. Alternatively, and/or in addition, the gap in area S4 (A16-A20) may be g+Δg and the gap in area S5 (A21-A25) may be g+3Δg, whereas the distance in the upper areas S1 and S2 increase uniformly. Other variations are readily appreciated one of ordinary skill based on the present disclosure.

The plasma display panel with the electrode structure within the discharge cell according to this embodiment preferably reduces the vertical luminance difference in the plasma display panel, since the gap between the transparent electrodes is relatively small for the center area. Hence, the amount of emission generated by applying the same signals is relatively large, in the discharge cells located in the center area of the upper substrate.

FIG. 8 is a diagram that illustrates the luminance property in each section of the plasma display panel with the electrode structure of FIG. 7 if the same signals, i.e. signals of 180V, 1.14 A, are applied to each of the scan electrodes and the sustain electrodes. The area S1 including sections A1 to A5 of the upper substrate exhibits an average luminance of 156.8, the area S2 including sections A6 to A10 exhibits an average luminance of 157.4, the area S3 including sections A11 to A15 exhibits an average luminance of 157.6, the area S4 including sections A16 to A20 exhibits an average luminance of 156.6, and the area S5 including sections A21 to A25 exhibits an average luminance of 156.8. The plasma display panel of this invention exhibits consistent luminance with relatively small error range in substantially all vertical areas of the upper substrate.

The plasma display panel with such electrode structure within the discharge cell reduces the vertical luminance difference in the plasma display panel, since the gap or span of distance between the transparent electrodes within the discharge cells included in the center area is relatively smaller and overall area of the transparent electrodes is relatively larger so that the amount of emission generated by applying the same signal is relatively larger in the center area. Such a reduction in the luminance difference is possible, although an inductance of scan/sustain electrode pair is different due to the length of scan/sustain electrode pair being longer in the upper and lower areas compared to the center area.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A plasma display panel comprising:

a plurality of scan electrodes arranged in a first direction; and a plurality of sustain electrodes arranged in the first direction, the scan electrodes and the sustain electrodes forming a plurality of electrode pairs, and a scan electrode of a pair being spaced apart from a sustain electrode of the pair by a prescribed gap of, wherein the plurality of electrode pairs being distributed between a plurality of regions, each region having at least three electrode pairs, and the prescribed gap of at least one region is different from the prescribed gap of at least one other region by a preset value, and the plurality of regions are provided in a display area of the plasma display panel, wherein the at least three electrode pairs include first, second and third pairs, and (a) a prescribed distance being formed between a scan electrode of the first pair and a scan electrode of a second pair or between a sustain electrode of the first pair and a sustain electrode of the second pair or between cells in the second direction, and (b) the prescribed distance being formed between the scan electrode of the second pair and a scan electrode of a third pair or between the sustain electrode of the second pair and a sustain electrode of the third pair or between cells in the second direction, wherein the prescribed distance of at least one region is different from the prescribed distance of at least one other region by a prescribed value.

2. The plasma display panel of claim 1, wherein the plurality of regions includes an upper region, a lower region and a center region therebetween.

3. The plasma display panel of claim 2, wherein the center region is at least 10% of the total display area.

4. The plasma display panel of claim 2, wherein the upper, lower and center regions have the same area or size, or the upper and lower regions have different area or size compared to the center region.

5. The plasma display panel of claim 2, (1) wherein the prescribed distance of the center region is smaller than the prescribed distance of at least one of the upper region or the lower region, (2) the prescribed distance of the upper region is smaller or larger than the prescribed distance of the lower region or (3) the prescribed distance of the center region is smaller than the prescribed distance of at least one of the upper region or the lower region, and the prescribed distance of the upper region is smaller or larger than the prescribed distance of the lower.

6. The plasma display panel of claim 2, wherein the upper region includes a plurality of first areas, and the lower region includes a plurality of second areas.

7. The plasma display panel of claim 6, wherein the number of first and second areas is the same or different.

8. The plasma display panel of claim 7, wherein the prescribed distance increase uniformly from a first area adjacent to the center region to the first area farthest from the center region or the prescribed distance changes non-uniformly from the first area adjacent to the center region to the first area farthest from the center region.

9. The plasma display panel of claim 7, wherein the prescribed distance increase uniformly from a second area adjacent to the center region to the second area farthest from the center region or the prescribed distance changes non-uniformly from the second area adjacent to the center region to the second area farthest from the center region.

10. A plasma display panel comprising:

a plurality of scan electrodes arranged in a first direction; and a plurality of sustain electrodes arranged in the first direction, the scan electrodes and the sustain electrodes forming a plurality of electrode pairs, and a scan electrode of a pair being spaced apart from a sustain electrode of the pair by a prescribed gap of, wherein the plurality of electrode pairs being distributed between a plurality of regions, each region having at least three electrode pairs, and the prescribed gap of at least one region is different from the prescribed gap of at least one other region by a preset value, and the plurality of regions are provided in a display area of the plasma display panel, wherein the plurality of regions includes an upper region, a lower region and a center region there between, and wherein (1) the prescribed gap of the electrode pairs in the center region is smaller than the prescribed gap of the electrode pairs in at least one of the upper region or the lower region, or (2) the prescribed gap of the electrode pairs in the upper region is smaller or larger than the prescribed gap of the electrode paths in the lower region, or (3) the prescribed gap of the electrode pairs in the center regions is smaller than the prescribed gap of the electrode pairs in at least one of the upper region or the lower regions, and the prescribed gap of the electrode pairs in the upper region is smaller or larger than the prescribed gap of the electrode pairs in the lower region.

11. The plasma display panel of claim 10, wherein the center region is at least 10% of the total display area.

12. The plasma display panel of claim 10, wherein the upper, lower and center regions have the same area or size, or the upper and lower regions have different area or size compared to the center region.

13. The plasma display panel of claim 10, wherein the upper region includes a plurality of first areas, and the lower region includes a plurality of second areas.

14. The plasma display panel of claim 13, wherein the number of first and second areas is the same or different.

15. The plasma display panel of claim 14, wherein the prescribed gap increases uniformly from a first area adjacent to the center region to the first area farthest from the center region or the prescribed gap changes non-uniformly from the first area adjacent to the center region to the first area farthest from the center region.

16. The plasma display panel of claim 14, wherein the prescribed gap increases uniformly from a second area adjacent to the center region to the second area farthest from the center region or the prescribed gap changes non-uniformly from the second area adjacent to the center region to the second area farthest from the center region.

17. The plasma display panel of claim 10, wherein the preset value is a fraction of the prescribed gap.

18. A method of making a plasma display panel comprising:

providing an upper substrate having a plurality of paired electrodes, each paired electrode including a scan electrode and a sustain electrode;

providing a lower substrate having a plurality of address electrodes, and a plurality of barrier ribs, each discharge cell being formed near or at an intersection of corresponding paired electrode and address electrode, wherein:

(a) the plurality of cells are divided into a plurality of areas, each area including at least three paired electrodes such that the at least three paired electrodes include first, second and third pairs, and (1) a prescribed distance being formed between a scan electrode of the first pair and a scan electrode of a second pair or between a sustain electrode of the first pair and a sustain electrode of the second pair or between cells in the second direction, and (2) the prescribed distance being formed between the scan electrode of the second pair and a scan electrode of a third pair or between the sustain electrode of the second pair and a sustain electrode of the third pair or between cells in the second direction, wherein the prescribed distance of at least one area is different from the prescribed distance of at least one other area by a prescribed value, and (b) a scan electrode of a paired electrode being spaced apart from a sustain electrode of the paired electrode by a prescribed gap, the plurality of paired electrodes being distributed between the plurality of areas, and the prescribed gap of at least one area is different from the prescribed gap of at least one other area by a preset value, wherein the plurality of areas is provided within a display area of the plasma display panel.

19. The plasma display panel of claim 1, wherein the prescribed value is a fraction of the prescribed distance.

20. The plasma display panel of claim 18, wherein the prescribed value is a fraction of the prescribed distance, and the preset value is a fraction of the prescribed gap.

* * * * *